US008061273B2

(12) United States Patent
Bayliss et al.

(10) Patent No.: US 8,061,273 B2
(45) Date of Patent: Nov. 22, 2011

(54) TUBULAR SIGNAL TRANSMISSION DEVICE AND METHOD OF MANUFACTURE

(75) Inventors: James Bayliss, Punta Gorda, FL (US); Ernest L. Gladden, Granby, CT (US); Joseph W. Twarog, Jr., Barkhamsted, CT (US)

(73) Assignee: Dyno Nobel Inc., Salt Lake City, UT (US)

( * ) Notice: Subject to any disclaimer, the term of this patent is extended or adjusted under 35 U.S.C. 154(b) by 910 days.

(21) Appl. No.: 10/553,931

(22) PCT Filed: Apr. 30, 2004

(86) PCT No.: PCT/US2004/013339

§ 371 (c)(1),
(2), (4) Date: Jan. 19, 2007

(87) PCT Pub. No.: WO2004/100177

PCT Pub. Date: Nov. 18, 2004

(65) Prior Publication Data

US 2007/0101889 A1 May 10, 2007

(51) Int. Cl.
*C06C 5/00* (2006.01)

(52) U.S. Cl. ..... 102/275.1; 102/275.8

(58) Field of Classification Search ..... 102/275.1, 102/277.1, 275.8, 275.9, 275.2, 275.3, 275.4
See application file for complete search history.

(56) References Cited

U.S. PATENT DOCUMENTS 1,964,390 A 6/1934 Stuart
2,416,639 A 2/1947 Pearsall
2,963,971 A 12/1960 Home
3,027,839 A 4/1962 Grandy et al.
3,590,739 A 7/1971 Persson
3,730,096 A 5/1973 Prior
4,220,087 A 9/1980 Posson
4,223,605 A * 9/1980 Larsson ..... 102/202.1
4,244,900 A 1/1981 Heider
4,288,262 A 9/1981 Flanagan et al.
4,290,366 A 9/1981 Janoski
4,328,753 A 5/1982 Kristensen et al.
4,402,270 A 9/1983 McCaffrey
4,493,261 A 1/1985 Simon et al.
4,607,573 A 8/1986 Thureson et al.
4,660,474 A 4/1987 Dias dos Santos (Continued)

OTHER PUBLICATIONS

Sartomer Product Bulletin: SR-238, 1,6 Hexanediol Diacrylate, 2027 R. Dec. 1998.

(Continued)

*Primary Examiner* — Benjamin P Lee
(74) *Attorney, Agent, or Firm* — Cantor Colburn LLP

(57) ABSTRACT

A signal transmission tube may be made by disposing a reactive polymeric material within a confinement tube and leaving a portion of the tube interior unoccupied. The tube may be formed by disposing a layer of paint comprising the reactive polymeric material on the interior surface of the confinement tube, extruding the confinement tube over an elongate rod that comprises the reactive polymeric material. The rod preferably has a high surface area configuration, e.g., the rod may comprise a longitudinal bore therethrough or may be star-shaped, cross-shaped, etc. Alternatively, the signal transmission tube may be made from the reactive polymeric material. Optionally, a sheath may be extruded over the tubular reactive polymeric material. In various embodiments, the confinement tube or sheath may be configured to be fractured or substantially consumed by the reaction of the reactive polymeric material. Optionally, the reactive polymeric material may comprise a glycidyl azide polymer.

24 Claims, 1 Drawing Sheet

U.S. PATENT DOCUMENTS

| | | | |
|---|---|---|---|
| 4,699,059 | A | 10/1987 | Kelly et al. |
| 4,756,250 | A | 7/1988 | Dias dos Santos |
| 4,757,764 | A | 7/1988 | Thureson et al. |
| 4,817,673 | A | 4/1989 | Zoghby et al. |
| 4,838,165 | A | 6/1989 | Gladden et al. |
| 4,841,856 | A | 6/1989 | Gisler et al. |
| 5,001,981 | A | 3/1991 | Shaw |
| 5,009,163 | A | 4/1991 | Robins et al. |
| 5,010,821 | A | 4/1991 | Blain |
| 5,048,420 | A | 9/1991 | Beck et al. |
| 5,101,729 | A | 4/1992 | Noble et al. |
| 5,166,470 | A | 11/1992 | Stewart |
| 5,208,419 | A | 5/1993 | Greenhorn et al. |
| 5,212,341 | A | 5/1993 | Osborne et al. |
| 5,243,913 | A | 9/1993 | Brent et al. |
| 5,316,600 | A | 5/1994 | Chan et al. |
| 5,317,974 | A | 6/1994 | Stewart et al. |
| 5,351,618 | A | 10/1994 | Brent et al. |
| 5,383,405 | A | 1/1995 | Everest |
| 5,431,100 | A | 7/1995 | Snyder |
| 5,435,249 | A | 7/1995 | Brent et al. |
| 5,473,987 | A | 12/1995 | Beck |
| 5,507,891 | A | 4/1996 | Zeigler |
| 5,509,355 | A | 4/1996 | Stewart et al. |
| 5,518,807 | A | 5/1996 | Chan et al. |
| 5,597,973 | A | 1/1997 | Gladden et al. |
| 5,616,883 | A | 4/1997 | Hamilton et al. |
| 5,625,162 | A | 4/1997 | Appleby |
| 5,629,493 | A | 5/1997 | Andersson et al. |
| 5,681,904 | A | 10/1997 | Manzara |
| 5,827,994 | A | 10/1998 | Gladden et al. |
| 5,837,924 | A | 11/1998 | Austin |
| 5,844,322 | A | 12/1998 | Andersson et al. |
| 5,945,627 | A | 8/1999 | Arpin et al. |
| 6,006,671 | A | 12/1999 | Yunan |
| 6,170,398 | B1 | 1/2001 | Rabotinsky et al. |
| 6,247,410 | B1 * | 6/2001 | Garcia ..... 102/275.8 |
| 6,347,566 | B1 | 2/2002 | Rabotinsky et al. |
| RE37,689 | E * | 5/2002 | Stewart et al. ..... 102/275.8 |
| 6,694,886 | B1 * | 2/2004 | Woodall et al. ..... 102/275.1 |
| 7,086,335 | B2 * | 8/2006 | O'Brien et al. ..... 102/275.8 |
| 7,434,515 | B2 * | 10/2008 | O'Brien ..... 102/275.8 |
| 2007/0272107 | A1 * | 11/2007 | Twarog et al. ..... 102/275.1 |

OTHER PUBLICATIONS

Anthony P. Manzara, 3M Specialty Chemicals Division, "A New Cure System for Azido Polymers", Approved for public release Apr. 1996, 8 pages.

http://www.chemicalland21.com/arokorhi/specialtychem/perchem/N-BUTYRYL%20CHL..., Apr. 15, 2004, N-Butyryl Chloride (Butanoyl Chloride), "n-Butyryl Chloride", 2 pages.

http://search.chemexper.com/__KFPNKUMHFTNBQNKQNQNMPOLQOE__?for=ccd&sea... Apr. 15, 2004, Poly(vinyl butyral), 1 page.

Rob Hunter and Tony Manzara, 3M Performance Materials, "Interaction of Glycidyl Azide Polymer Plasticizer With Other Polymers", 8 pages, facsimile-transmitted Apr. 26, 2002.

3M Industrial Products Division, technical data Glycidyl Azide Polymer Polyol L-12369 (Experimental), issued Dec. 1991, 2 pages.

3M Industrial Products Division, technical data Glycidyl Azide Polymer Polyol L-12616 (Experimental), issued Apr. 1992, 2 pages.

PCT International Search Reprot and Written Opinion received in corresponding PCT Application No. PCT/US04/13339, dated Jan. 6, 2005, 9 pages.

PCT International Preliminary Examination Report on Patentability received in corresponding PCT Application No. PCT/US04/13339, dated Nov. 4, 2005, 5 pages.

* cited by examiner

TUBULAR SIGNAL TRANSMISSION DEVICE AND METHOD OF MANUFACTURE

BACKGROUND OF THE INVENTION

1. Field of the Invention

This invention relates to initiation signal transmission lines used in mining and other blasting operations and, in particular, to tubular initiation signal transmission lines such as shock tube and low velocity signal tube.

2. Related Art

U.S. Pat. No. 5,681,904 entitled "Azido Polymers Having Improved Burn Rate", issued Oct. 28, 1997 and relates to azido polymers, especially cross-linked azido polymers that can be used as high-energy materials. As disclosed starting at column 1, line 10, azido-containing compounds and polymers are important in the fields of explosives and propellants because the azido group is highly energetic and can easily be incorporated into a polymer or oligomer at high weight percent loadings. One especially useful class is described starting at column 1, line 14, as azido-substituted polyethers, for example, glycidyl azide polymer. Although hydroxylated azido-substituted polyethers are often cured with polyisocyanates via a urethane-forming mechanism for energetic material applications, as disclosed starting at column 2, line 9, it has been discovered that liquid azido polymers can be cross-linked to some or all of the azido groups with a multi-functional dipolarophile having a reactive group selected from acrylic and acetylenic esters or amides to produce a polymer material containing triazoline and/or triazole groups. These materials are said to have advantages relative to the polyisocyanate-cured polymers. Such polymers, including glycidyl azide polymers ("GAP") are commercially available from Minnesota Mining and Manufacturing Company ("3M Company") of St. Paul, Minn. The disclosure of U.S. Pat. No. 5,681,904 is incorporated by reference herein.

It is conventional practice in mining and other blasting operations to employ non-electric initiation signal transmission tubes to transmit initiation signals from an igniter device to an initiator device such as a detonator that is used to initiate another reactive device, e.g., to set off an explosive charge such as a borehole explosive charge, e.g., a PETN-containing booster charge which, in turn, may initiate a borehole blasting agent such as ANFO. Two well-known types of non-electric signal transmission tubes are known in the art as shock tube and low velocity signal transmission tube, and are referred to collectively as signal transmission tubes. Typically, a signal transmission tube comprises a flexible but resilient tube having a thin layer of reactive powder material adhered to the inner wall, leaving a continuous open channel along the length of the tube.

Generally, signal transmission tube may be formed from an extruded synthetic polymeric material such as EAA (ethylene/acrylic acid copolymer), EVA (ethylene vinyl acetate) or a SURLYN™ such as SURLYN™ 8940, an ionomer resin available from E. I. DuPont de Nemours Company of Wilmington, Del., low density polyethylene (LDPE), linear low or medium density polyethylene, linear low, medium and high density polyester and polyvinylidene chloride (PVC), and suitable blends or polymer alloys of such materials. A signal transmission tube may comprise multiple, concentric, co-extruded layers, the outer layer or layers usually being made of a mechanically tougher polymer than the innermost layer. The material used to manufacture the signal transmission tube is generally chosen so that the finished tube will be sufficiently flexible to permit the necessary handling, but will also be of sufficiently high tensile strength and resiliency to resist breakage and sufficiently tough to resist abrasion, cutting or nicking of the tube during use. In fact, conventional signal transmission tubes are so resilient and strong that an initiation signal passing therethrough does not substantially affect the physical integrity of the tube, which remains intact after the signal passes there-through. This allows signal transmission tubes to be used advantageously on the surface of a blasting site where air blast and associated noises are unwanted, as well as for the transfer of an initiation signal through explosive material (such as a borehole charge) to a detonator for the explosive material without causing premature detonation or disrupting the explosive charge in the borehole.

U.S. Pat. No. 5,597,973 to Gladden et al, dated Jan. 28, 1997, entitled "Signal Transmission Fuse", is concerned with shock tube of specific and inventive dimensions and proportions, and which contains a pulverulent reactive material disposed on the inner surface of the tube. For example, see column 2, line 38 et seq of U.S. Pat. No. 5,597,973.

Another of many patents dealing with shock tube is U.S. Pat. No. 6,170,398 to Rabotinsky et al, dated Jan. 9, 2001, entitled "Signal Transmission Fuse", which discloses a shock tube which encases a support tape which has a reactive coating adhered to one side of the tape by a binder.

In most cases in the prior art, the reactive material is a pulverulent material which adheres to the interior of the hollow tube by the attraction of the powder particles to the plastic from which the interior wall of the tube is made. That material is usually an ionic ethylene methacrylic acid polymer, such as that sold under the trademark SURLYN® by E. I. DuPont de Nemours Company of Wilmington, Del. The pulverulent reactive material is mainly "unembedded", meaning that it is not held on the tube wall by an adhesive, binder or the like.

One art-recognized difficulty is migration of the unembedded pulverulent reactive material, which is conventionally held in place only by electrostatic or other attraction to the plastic of which the interior surface of the tube is made. During shipment, handling or installation, portions of the pulverulent reactive material tend to detach from the tube wall, possibly resulting in bare spots on the interior of the tube and/or accumulation of powder, especially in kinks or in curved portions of the tube, which then may be plugged with the loose reactive powder that may interrupt the transmission of a signal therethrough, resulting in a misfire. Powder migration is a problem because, in products where lengths of the signal transmission fuse are connected to devices such as detonators, migrating powder can collect atop the explosive or pyrotechnic contained within the detonator and shield the explosive or pyrotechnic from the signal generated in the shock tube, thereby resulting in a misfire. Localized concentrations of powder can lead to blow-outs of the tube wall which will result in undesired variations of the reaction pressure. Of course, if powder migration is so severe as to leave sections of the fuse with insufficient powder adhered thereto to sustain the reaction, a propagation failure will occur. Reliability of performance of shock tube is always of vital importance, especially in certain applications, e.g., air bag devices, where malfunctioning can lead to injuries.

U.S. Pat. No. 4,756,250 to Dias dos Santos, dated Jul. 12, 1988, entitled "Non-Electric and Non-Explosive Time Delay Fuse, discloses fuses comprising hollow tubes into which pyrotechnic mixtures are blown to deposit pyrotechnic material into the tubes.

Adhering the reactive material to a tape contained within the tube by means of a binder as disclosed in U.S. Pat. No.

6,170,398 is an attempt to overcome the problem of powder migration, but requires a more complicated manufacturing technique.

One disadvantageous result of the resilience, toughness and tensile strength of conventional signal transmission tube such as shock tube is that after the blasting operation, the blasting area is littered with spent but intact tube carcass. The tube carcass may clog up mine processing equipment and may tangle in rotating parts of mining equipment such as the axles or shafts in earth-moving equipment and crushing machinery employed at the blasting site shortly after the tube is used, and may require frequent removal. For example, tube carcasses often snag on earth-moving equipment such as bulldozers, forcing the operator to stop the bulldozer to cut tube carcass from the equipment and to collect and remove tube carcass from the work site. Prior attempts to address this problem have included providing tube that splits upon functioning. On a longer time frame, those portions of conventional tube carcasses, or fragments thereof, that remain on the blasting site or that are transported elsewhere constitute solid waste that is not very susceptible to biodegradation.

SUMMARY OF THE INVENTION

A method for making a signal transmission tube comprises disposing a reactive polymeric material within a confinement tube and leaving a portion of the tube interior unoccupied. According to various optional aspects of the invention, which may be embodied individually or in various combinations, the interior of the confinement tube may be substantially free of pulverulent reactive material; the reactive polymeric material may comprise a glycidyl azide polymer (GAP material) which may optionally be obtained by cross-linking a GAP resin with multifunctional dipolarophiles; the method may comprise forming the confinement tube and disposing a layer of paint on the interior surface of the confinement tube, wherein the paint comprises the reactive polymeric material; and/or the method may comprise extruding the confinement tube over an elongate rod that comprises the reactive polymeric material.

According to another aspect of the invention, a signal transmission tube comprises a reactive polymeric material disposed within a confinement tube, wherein the reactive polymeric material is configured to leave a portion of the interior of the confinement tube unoccupied.

Various optional aspects of the invention which may be embodied individually or in various combinations. Optionally, for example, the interior of the confinement tube may be substantially free of pulverulent reactive material. Optionally, the reactive polymeric material may comprise a GAP material. The signal transmission tube may comprise a layer of paint on the interior surface of the confinement tube, the paint comprising the reactive polymeric material; and/or it may comprise a reactive polymeric material in the form of a rod disposed within the confinement tube. Optionally, the rod may have a high surface area configuration and/or the rod may comprise a longitudinal bore therethrough.

A method for making a signal transmission tube comprises extruding a reactive polymeric material into a tubular form. Optionally, the method may further comprise extruding a sheath over the tubular reactive polymeric material. In one embodiment, the sheath may be configured to be fractured by the reaction of the reactive polymeric material. Optionally, the sheath may be configured to be consumed by the reaction of the reactive polymeric material. In various embodiments, the reactive polymeric material may comprise a GAP material.

In another embodiment, a signal transmission tube comprises a reactive polymeric material in the form of a tube. Optionally, the interior the tube is substantially free of pulverulent reactive material. In one particular embodiment, a sheath may be disposed over the tube comprising the reactive polymeric material. The sheath may be configured to be fractured and/or at least partially consumed by the reaction of the reactive polymeric material.

DETAILED DESCRIPTION OF THE INVENTION AND SPECIFIC EMBODIMENTS THEREOF

Figure 1:
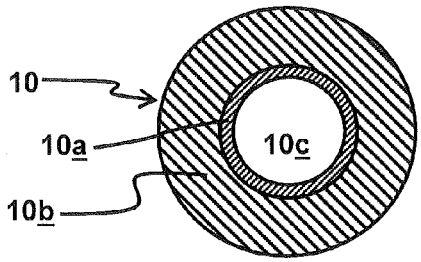
FIG. 1 is a cross-sectional view of a shock tube whereby the interior wall is coated with a reactive polymeric material in accordance with one embodiment of the present invention.

A signal transmission tube as described herein comprises, instead of pulverulent reactive material, a reactive polymeric material. In some embodiments, the signal transmission tube comprises a confinement tube within which the reactive polymeric material is disposed as a rod within the confinement tube or as a layer of a coating composition (e.g., a paint) on the interior surface of the tube. In such embodiments, the confinement tube is preferably made of a non-reactive material or materials, such as the single- or multiple-ply hollow polyethylene and/or SURLYN® tubes conventionally used in shock tubes.

Reactive polymeric materials are polymeric materials that have reactive pendant groups such as azido groups, nitrate groups, triazoline groups and/or triazole groups chemically bonded to the polymer backbone, rather than comprising a relatively inert polymeric material or resin having pulverulent reactive material physically blended therein. However, a reactive polymeric material may optionally have pulverulent reactive materials blended therein such as oxidizer additives, e.g., ammonium perchlorate and/or ferric oxide, or pyrotechnic or explosive materials.

Some reactive polymeric materials may be obtained by cross-linking resinous (e.g., liquid) azido polymers such as glycidyl azido polymer (GAP) resin, which is, as described in U.S. Pat. No. 5,681,904 (which is hereby incorporated herein by reference), has pendant azido groups and is commercially available in polyol form (having hydroxyl functional end groups) or as a plasticizer (non-hydroxylated resin). The GAP polyol resin may be cross-linked with, e.g., polyisocyanate, to react with the hydroxyl end groups, producing a reactive polymeric material having azido pendant groups. Alternatively, GAP resins (either polyol or plasticizer) may be cross-linked with multi-functional dipolarophile molecules such as acrylic esters, acrylic amides, acetylenic esters, acetylenic amides, and/or mixtures thereof, which react with the azido groups (and which therefore do not require the polyol resin form) and which may be used in amounts of about 10 to about 100 parts per hundred (pph) parts of the resin (by weight). The resulting reactive polymeric material comprises triazole and/or triazoline groups. Two example cross-linking agents of this kind are pentaerytritol triacrylate (PETA) and/or dipentaerythritol hexaacrylate (DPEHA). Cross-linking occurs under relatively mild conditions, e.g., at ambient temperatures. Cross-linking may be initiated or controlled by radiation techniques, e.g., UV radiation, electron beam radiation, X-ray, etc. The The reactive polymeric material, when applied as a coating of resin and cross-linking agent to the interior surface of a tube made of non-reactive material, exhibits good adhesive capability relative to the material of the interior surface of the hollow tube. In other embodiments, the reactive polymeric material is formed into a tube that propagates the signal without the need for a confinement tube. Similarly, the tube wall may optionally be free of embedded reactive material, although in certain embodiments, the reactive polymeric material may include pulverulent reactive material (e.g., an oxidizer) embedded therein. In all embodiments, at least a portion of the interior of the tube is open, i.e., unoccupied, by solid material. The open interior is believed to facilitate the formation and propagation of a reaction front resulting from the reaction of the reactive polymeric material of the tube. Signal transmission tubes as described herein may be used in the same manner as other tubes, e.g., to convey initiation signals to squibs or detonators in borehole charges or the like.

The use of reactive polymeric material to propagate a signal in the tube reduces and may remedy problems associated with tubes that rely principally on unembedded powdered reactive materials to convey the reaction signal, i.e., problems of powder migration (the spalling of reactive material from the interior surface of the tube) and the need to seal the tube interior against the introduction of moisture, small amounts of which may severely inhibit the proper functioning of the tube, because reactive polymeric materials will not spall and migrate, and they are relatively unaffected by ambient moisture. In certain embodiments, the interior of the signal transmission tube may be substantially free of unembedded pulverulent reactive material or, optionally, substantially free of all pulverulent reactive material. Similarly, the tube wall may optionally be free of embedded reactive material, although in other embodiments the reactive polymeric material may contain a pulverulent reactive material (e.g., an oxidizer) embedded therein.

To apply a reactive polymeric material on a tube wall in the form of a coating composition, the coating composition may initially be dissolved or suspended in a liquid vehicle to provide a liquid coating composition that may be aspirated into the confinement tube, optionally simultaneously while the tube is being formed. In such case, the liquid vehicle may be removed by evaporation, leaving the coating composition comprising the reactive polymeric material deposited on the tube wall. In some embodiments, the coating composition may comprise an adhesive in addition to the reactive polymeric material, to enhance adhesion of the reactive polymeric material to the tube wall. Optionally, the liquid coating composition may include a wetting agent, to facilitate the formation of a smooth, uniform coating on the tube wall. Alternatively, the wetting agent may be applied to the tube wall before the liquid coating composition is aspirated therein.

One embodiment of such a tube is shown in FIG. 1 as a cross-sectional view of a signal transmission tube (e.g., shock tube) 10 comprising a hollow tube 10*b* made of a generally non-reactive (i.e., non-energetic) material, optionally a polymeric material such as polyethylene or polyvinyl chloride (PVC) or SURLYN® polymer or the like. On the interior surface of tube 10*b* is adhered a polymeric coating composition 10*a* that comprises a reactive polymeric material, e.g., a GAP material, which comprises a cross-linked GAP resin. In one embodiment, GAP resin may be cross-linked with multifunctional dipolarophiles to provide excellent adhesive retention to the interior surface of a confinement tube. The coating composition 10*a* is applied to the interior wall of plastic tube 10*b*, leaving a hollow bore 10*c* extending through the entire length of shock tube 10. Tube 10*b* contains no unembedded pulverulent reactive materials, e.g., powders comprised of aluminum and/or a high explosive such as RDX, PETN or deflagrating materials or the like, adhered electrostatically, or otherwise attracted to, the interior surface of the tube or disposed therein.

In a particular embodiment, the coating composition on the interior wall of the tube comprises a GAP resin, a cross-linking agent, and other optional ingredients in a liquid vehicle (solvent). Suitable solvents for a GAP resin include xylene, MEK (methylethyl ketone), acetone, diethylether, ethanol and ethyl acetate.

An evenly coated application without voids is facilitated by including a wetting agent such as polyvinyl butyral (PVB). For example, a 1% solution of PVB in ethanol may be added to the paint to provide wetting of the surface of the interior wall of the tube. The GAP paint is aspirated into the interior of the shock tube whereby it adheres through an adhesive agent in the solvent and/or by an agent in the paint bonding to the wall. Alternatively, a wetting agent may be applied to the interior surface of the tube before the GAP paint is applied. For example, the PVB solution may be aspirated into the tube, which may then be thoroughly dried with hot air before the GAP paint is aspirated therein. The coating composition may then be aspirated into the PVB-coated tube, and adhesion is achieved by an adhesive agent dissolved in the solvent and/or by an agent in the paint which attacks the wall.

The GAP coating composition may be applied with various coating weights per linear length of tube to control the velocity of detonation of the resulting shock tube. Some embodiments of GAP coating compositions are elastomeric and may withstand up to 20% stretching of the shock tube without detriment to the adhesion. In some applications, coating adhesive strength is essential for proper functioning of signal transmission tubes.

In one sample embodiment, a tube having an interior diameter of about 1/16 inch (about 0.16 centimeter) was wetted with a 1% PVB solution, allowed to dry, and was then coated (by aspiration) with a paint composition comprising GAP resin and a cross-linking agent, in an amount of about 50 milligrams per meter of the tube. The resulting signal tube functioned properly from end to end. Another sample was prepared in the same way, except that the paint comprised, in addition to GAP plasticizer (i.e., non-polyol resin), 25% PETA, 3% ammonium perchlorate, 1% ferric oxide and 1% GAP polyol resin. This sample also performed properly, i.e., a highly exothermic signal propagated therethrough from end to end.

In another embodiment, the reactive polymeric material may be disposed in the confinement tube in the form of a rod, over which the confinement tube may be extruded. Optionally, the rod comprising the reactive polymeric material and the confinement tube may be co-extruded. The rod may have a round cross-sectional configuration or it may be configured to have a high surface area relative to its linear density, i.e., it may have any one of various non-round cross-sectional shapes such as a wagon wheel cross section with spokes and hub, a star shape, a cross shape, etc. Optionally, the rod may be hollow, i.e., it may be formed with one or more longitudinal bores or passageways therethrough which, for purposes of this invention, provide a high surface area configuration.

Upon initiation, the rate of reaction will be increased dramatically because of the high surface area-to-volume ratio of the reactive material rod confined within the tube. Burn speed will depend upon the pressure developed by the reaction products of the reactive material and the relative confinement provided by the surrounding tube. If the confinement tube is sufficiently thin, it may be at least partially consumed or fractured by the reaction, leaving minimal residue.

Figure 2:
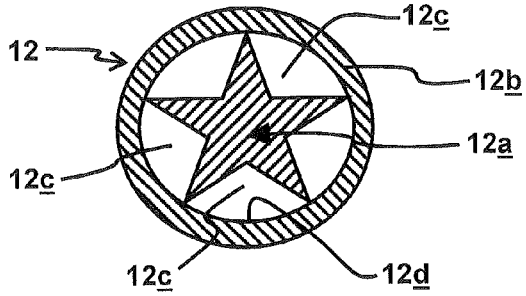
FIG. 2 is a cross-sectional view of a star-shaped solid rod comprised of a reactive polymeric material confined within a plastic tube with hollow areas between the star points and the shock tube wall, which extends throughout the length of the tube in accordance with another embodiment of the present invention.

One embodiment of such a tube is shown in FIG. 2, which illustrates a signal tube 12 comprised of a hollow confinement tube 12*b* of non-reactive polymeric material (e.g., polyethylene) which is extruded over a rod 12*a* that comprises reactive polymeric material comprising glycidyl azide polymer cast into a star-shaped cross-sectional configuration. The open areas 12*c* between the star points and the tube interior wall 12*d* leave open a portion of the interior of tube 12*b* and provide hollow bores or passageways extending along the entire length of signal tube 12, providing confined flame channels which will increase the rate of reaction of rod 12*a* upon initiation. The burn speed of signal tube 12 depends upon the developed pressure, which is a function of the gas volume produced per unit of time, and the relative confinement of the reaction provided by tube 12*b*. A sufficiently thin hollow tube 12*b* can be substantially consumed or fractured along with the reactive glycidyl azide polymer material of rod 12*a*, leaving minimal residue from the reaction. In one embodiment, tube 12*b* may also comprise glycidyl azide polymer and/or another reactive polymeric material and may be consumed along with rod 12*a* upon initiation of signal tube 12.

Figure 2A:
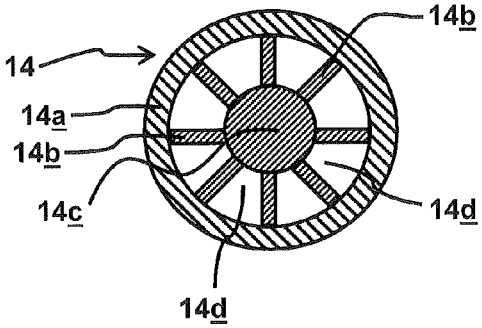
FIG. 2A is a cross-sectional view of a shock tube cast in wagon wheel structure whereby the spokes and axle are comprised of a reactive polymeric material and the wall is a plastic tube and the area between the spokes remains hollow throughout the extension of the tube in accordance with the present invention.
Figure 2B:
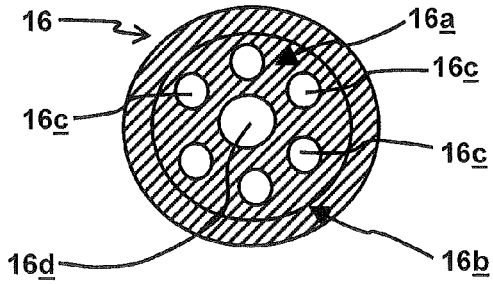
FIG. 2B is a cross-sectional view of an extruded rod encased in a plastic sheath with a plurality of circular, evenly-spaced voids surrounding the hollow core extending throughout the length of the rod, the body of which is comprised of a reactive polymeric material in accordance with the present invention.

FIGS. 2A and 2B show other embodiments of the present invention. FIG. 2A is a cross-sectional view of a GAP material rod having, in cross section, the appearance of the spokes (14*b*) and hub (14*c*) of a wheel. The wall 14*a* surrounding the GAP material rod is comprised of conventional, non-reactive plastic tubing. The open areas between the spokes comprise bores or passageways 14*d* which extend along the entire length of shock tube 14, whereby the flame is transported through the bores 14*d*.

In yet another embodiment, the rod of reactive polymeric material may comprise longitudinally extending bores or passageways extending along the entire length thereof, i.e., it may comprise a bore-containing rod. A plastic tube is over-extruded onto the GAP material rod, leaving the hollow bores or passageways extending along the entire length of the resulting shock tube. For example, FIG. 2B is a cross-sectional view of a shock tube 16 comprised of an extruded rod 16*a* made of GAP material and encased in a confinement tube 16*b*. Rod 16*a* contains multiple evenly-spaced passageways 16*c* surrounding a central hollow bore 16*d* which, in the illustrated embodiment, is of larger diameter than passageways 16*c*. As in the other embodiments, confinement tube 16*b* is made of a non-reactive plastic material. Although rod 16*a* is in contact with sheath 16*b* around its entire circumference, a portion of the interior bore of sheath 16*b* is nonetheless unoccupied (i.e., open) due to the central hollow bore 16*d* and passageways 16*c* of rod 16*a*. When the non-reactive outer tube is made thin enough to be ruptured or substantially consumed by the reactive material, the residue left after initiation of the shock tube is minimized.

In an alternative embodiment, tube 16*b* may also comprise a reactive polymeric material. In such case, substantially all of shock tube 16*b* may be consumed when it functions.

As discussed in U.S. Pat. No. 5,827,994, the advantage of minimal residue left by shock tube tubes in the aftermath of an explosion at a blasting site precludes the necessary removal of spent shock tube "carcasses" littering the work site. Such carcasses tend to clog rotating parts of earth-moving or mining equipment and vehicles operating at the site and necessitate frequent downtime for removal of tangled carcasses.

Figure 3:
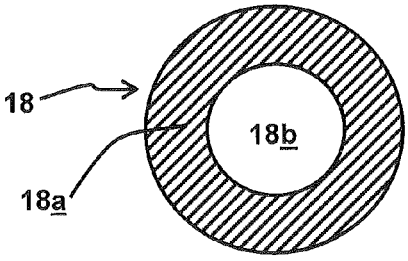
FIG. 3 is a cross-sectional view of a shock tube entirely constructed of a reactive polymeric material in accordance with a third embodiment of the present invention.

Still another embodiment of the present invention provides a shock tube, i.e., a hollow tube, entirely constructed of the reactive, cured GAP material. In this embodiment, the reactive polymeric material is sufficiently strong to have the tensile strength and resiliency needed for ordinary on-site handling prior to use. Once ignited, the tube incinerates, leaving no significant remnants behind. For example, as shown in cross section in FIG. 3, the shock tube 18, the body 18*a* of which is entirely comprised of reactive GAP material, defines a hollow bore 18*b* extending therethrough. Shock tube 18 is extruded as a GAP resin containing a cross-linking agent, and is polymerized/cross-linked, e.g., by radiation, to hold its extruded shape. Once initiated, the wall structure will incinerate with no residue or carcass remaining. Optionally, a thin sheath comprising non-reactive polymeric material (e.g., polyethylene, SURLYN®, etc.) may be applied over the body 18*a*. Preferably, sheath 18 is thin enough to be substantially consumed upon the initiation of the reactive polymeric material of tube 18. Such a sheath, in contrast to a confinement tube, does not have sufficient structural strength to contain the brisant output generated by the tube body 18*a*. The sheath may serve, however, to facilitate handling or further processing of the shock tube.

While the invention has been described with reference to specific embodiments thereof, it will be appreciated that numerous other variations may be made to the illustrated specific embodiment which variations nonetheless lie within the spirit and the scope of the invention and the appended claims.

What is claimed is:

1. A method for making a signal transmission tube, the method comprising extruding over an elongate rod a confinement tube having an inner wall defining an interior of the confinement tube, the rod being comprised of a solid reactive polymeric material having reactive pendant groups chemically bonded to the polymer backbone and being configured to provide a continuous, longitudinally extending unoccupied portion of the interior of the confinement tube.

2. The method of claim 1 wherein the interior of the confinement tube is substantially free of unembedded pulverulent reactive material.

3. The method of claim 1 wherein the reactive polymeric material comprises a GAP material.

4. The method of claim 3 wherein the reactive polymeric material comprises a GAP resin that has been cross-linked with a multifunctional dipolarophile material.

5. A method for making a signal transmission tube, the method comprising forming a confinement tube having an inner wall defining an interior of the confinement tube, and disposing a layer of paint on the inner wall of the confinement tube, wherein the paint comprises a reactive polymeric material having reactive pendant groups chemically bonded to the polymer backbone and the layer of paint is configured to provide a continuous, longitudinally extending unoccupied portion of the interior of the confinement tube.

6. A signal transmission tube comprising a reactive polymeric material having reactive pendant groups chemically bonded to the polymer backbone and being configured as a solid elongate rod, the rod being disposed within a confinement tube having an inner wall defining an interior of the confinement tube, wherein the reactive polymeric material rod is configured to provide a continuous, longitudinally extending unoccupied portion of the interior of the confinement tube.

7. The signal transmission tube of claim 6 wherein the interior of the confinement tube is substantially free of unembedded pulverulent reactive material.

8. The signal transmission tube of claim 7 wherein the reactive polymeric material comprises a GAP material.

9. The signal transmission tube of claim 6, claim 7 or claim 8 wherein the rod is configured to have one or more radially extending portions thereof act as spacers between the rod and the inner wall of the confinement tube, whereby to define between the rod and the inner wall the continuous, longitudinally extending unoccupied portion.

10. The signal transmission tube of claim 6, claim 7 or claim 8, wherein the rod is configured to have a longitudinal bore extending therethrough, the longitudinal bore defining the continuous, longitudinally extending unoccupied portion.

11. A signal transmission tube comprising a confinement tube having an interior defined by an inner wall of the confinement tube, and a layer of paint disposed on the inner wall of the confinement tube to provide a continuous, longitudinally extending unoccupied portion of the interior of the confinement tube, the paint comprising a reactive polymeric material having reactive pendant groups chemically bonded to the polymer backbone.

12. The signal transmission tube of claim 11 wherein the reactive polymeric material comprises a GAP material.

13. A method for making a signal transmission tube, which tube consists of a reactive polymeric material having reactive pendant groups chemically bonded to the polymer backbone, the method comprising extruding the reactive polymeric material into tubular form.

14. A method of making a signal transmission tube, which tube consists of a reactive polymeric material having reactive pendant groups chemically bonded to the polymer backbone, the reactive polymeric material having one or more pulverulent reactive materials blended therein.

15. A signal transmission tube in the form of a tube and consisting of a reactive polymeric material having reactive pendant groups chemically bonded to the polymer backbone.

16. A signal transmission tube consisting of a reactive polymeric material having reactive pendant groups chemically bonded to the polymer backbone and having embedded therein one or more pulverulent reactive materials.

17. The signal transmission tube of any one of claims 6, 11, 15 and 16 wherein the reactive pendant groups are selected from the group consisting of one or more of azido groups, nitrate groups, triazoline groups and triazole groups.

18. The signal transmission tube of claim 15 or claim 16 wherein the reactive polymeric material comprises a GAP material.

19. The signal transmission tube of claim 18 comprising a GAP resin that has been cross-linked by a multifunctional dipolarophile material.

20. A method for making a signal transmission tube, comprising extruding a reactive polymeric material having reactive pendant groups chemically bonded to the polymer backbone into tubular form, extruding a sheath over the resulting tubular reactive polymeric tube, the sheath being configured to be fractured by reaction of the reactive polymeric material.

21. A method for making a signal transmission tube, comprising extruding a reactive polymeric material having reactive pendant groups chemically bonded to the polymer backbone into tubular form, extruding a sheath over the resulting tubular reactive polymeric tube, the sheath being configured to be consumed by reaction of the reactive polymeric material.

22. The method of claim 20 or claim 21 wherein the reactive polymeric material comprises a GAP material.

23. The method of claim 20 or claim 21 wherein the reactive polymeric material comprises a GAP resin that has been cross-linked by a multifunctional dipolarophile material.

24. The method of any one of claims 13, 14, 20 or 21 wherein the reactive pendant groups are selected from the group consisting of one or more of azido groups, nitrate groups, triazoline groups and triazole groups.

* * * * *